United States Patent [19]

Yoshikawa et al.

[11] 4,193,680

[45] Mar. 18, 1980

[54] TRANSFER SHEET DRYING DEVICE FOR ELECTROPHOTOGRAPHIC COPYING MACHINE

[75] Inventors: Akira Yoshikawa; Kouichi Aota, both of Ebina, Japan

[73] Assignee: Rank Xerox Limited, London, England

[21] Appl. No.: 810,812

[22] Filed: Jun. 28, 1977

[30] Foreign Application Priority Data

Nov. 16, 1976 [JP] Japan ..... 51-152788[U]

[51] Int. Cl.[2] ..... G03G 15/00

[52] U.S. Cl. ..... 355/3 R; 219/216; 355/30

[58] Field of Search ..... 355/3 R, 3 FU, 3 TR, 355/30; 219/216, 388 W; 432/59, 60

[56] References Cited

U.S. PATENT DOCUMENTS

| | | | |
|---|---|---|---|
| 3,349,221 | 10/1967 | Schulze et al. | 355/3 R |
| 3,349,222 | 10/1967 | Johnston | 219/216 X |
| 3,634,007 | 1/1972 | Verderber et al. | 355/3 R |
| 3,848,988 | 11/1974 | Thettu et al. | 355/3 R |
| 3,966,199 | 6/1976 | Silverberg | 355/3 TR |
| 4,008,955 | 2/1977 | Bar-on | 355/3 FU |

*Primary Examiner*—R. L. Moses

[57] ABSTRACT

A transfer sheet drying device for an electrophotographic copying machine which comprises a heating plate 2 having a plurality of narrow grooves 5 cut in a parallel direction with the copy sheet direction of movement, said heating plate 2 being provided as a transfer sheet transporting device disposed prior to a transferring station. A copy sheet keep member 6 rotatably provided on said heating plate 2 cooperates therewith to form an area through which the transfer sheet passes.

3 Claims, 4 Drawing Figures

TRANSFER SHEET DRYING DEVICE FOR ELECTROPHOTOGRAPHIC COPYING MACHINE

This invention relates to a transfer sheet drying device for an electrophotographic copying machine, and more particularly to a device for drying the transfer sheet before transferring an image thereto for utilization in the copying machine.

It is a matter of common knowledge that if a transfer or copy sheet having a high moisture content is used in a xerographic copying machine of the transfer type, improper transferring of images to the sheet takes place and curling of the sheet also occurs during the fixing step of the process due to its content.

For the purpose preventing such problems, various individual devices have been devised, but they were less effective or were entirely ineffective if the transfer sheet was extremely high in moisture content.

A method of drying transfer sheets in a paper sheet tray and a process for drying the transfer sheet at position out of the paper sheet tray, etc. as a methods of reducing moisture contained in the transfer sheet have been proposed.

Examples of the former method are a device in which a lamp for preventing hygroscopic moisture buildup in the transfer sheet is mounted at the upper position of the paper sheet tray, and a device in which a planar heater is furnished at the sheet tray, as disclosed in Japanese Utility Model Laid-Open Publication No. 50044/1973.

Since the transfer sheet is not used in an entirely dried state especially when the transfer sheet is fed out of the tray immediately after the transfer sheet in a highly moistened state is set into the paper sheet tray, the aforementioned difficulties cannot be obviated. In addition, because the transfer sheet in the tray cannot be maintained in a dry state unless the heater, lamp, etc. is always operated, undesirable operating requirements are present.

Examples of the latter method (i.e. drying the transfer sheet out of the paper tray) are a method for drying the transfer sheet with a heating plate provided at the copy sheet transport positioned between the sheet tray and the transfer station as disclosed in Japanese Utility Model Laid-Open Publication No. 16853/1973, and a method for drying the transfer sheet with a heating roll provided at the aforementioned sheet transport as disclosed in Japanese Utility Model Laid-Open Publication No. 130336/1975.

These latter methods can eliminate the difficulties of the former devices because they dry only the transfer sheet used.

However, since these latter methods uniformly heat the entire surface of the transfer sheet so as to completely dry the sheet, the transfer sheet is deformed or uneven immediately after drying. More particularly, it is generally considered that since the mositure contain of the sheet is not uniform over the entire surface of the sheet because of non uniform quality of sheet that if the entire surface of the transfer sheet is uniformly heated, portions thereof containing less moisture are contracted at a greater rate than moisture portions in response to dehydration.

This invention contemplates the elimination of the aforementioned difficulties, and an object of this invention is to provide a transfer sheet drying device for an electrophotographic copying machine which dries only the transfer sheet used and which can also prevent the unevenness of the transfer sheet when dried.

This invention will now be described with reference to the embodiments of this invention disclosed in the drawings.

Figure 1:
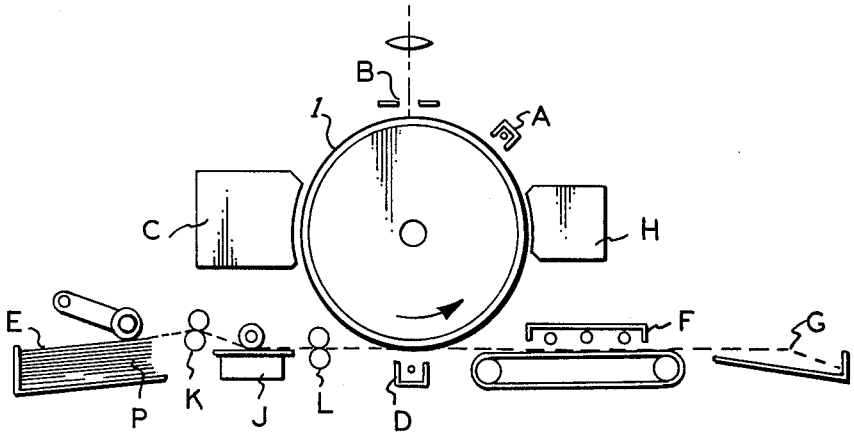
FIG. 1 is a schematic view of a xerographic copying machine representing the invention.

FIG. 1 is a schematic view of the xerographic copying machine representing this invention. As shown, a toner image is formed on the peripheral surface of a photosensitive drum 1 through the respective steps of charging at section A, exposure at section B and developing at section C as the drum is rotated. Then, the aforesaid toner image is transferred at a transfer section D onto a transfer sheet P fed from a sheet supply section E. Then, the toner image on the sheet P is fixed at a fixing section F and the sheet thus treated is discharged into a sheet receiving tray G. The surface of the photosensitive drum after transferring is passed through a cleaning section H and is then reused.

A transfer sheet drying device J is provided between the sheet supply section E and the transfer section D, and a pair of transport rollers K and L are disposed thereat.

Figure 2:
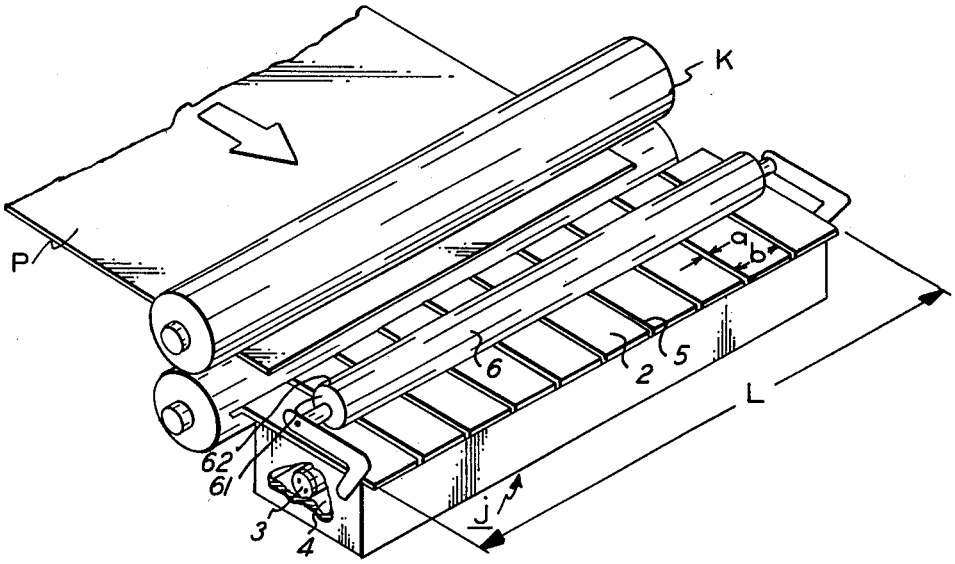
FIG. 2 is a perspective view of one embodiment of the transfer sheet drying device constructed according to this invention.

FIG. 2 is a perspective view of the transfer sheet drying device. As shown, there is provided a heating chamber 4 having a proper heat source 3 therein under the heating plate 2, which source 3 is maintained at proper temperature by a temperature control means (not shown). A plurality of narrow grooves 5 are cut in a direction parallel with the sheet's direction of movement at regular intervals in the surface of the heating plate 2. and A rotatable sheet keeper roller 6 is provided on the heating plate 2 as a copy sheet keeper member. By means of the keeper roller 6, the transfer sheet P uniformly contacts the entire surface of the heating plate 2. The narrow grooves 5 are so constructed as to pass through the heating plate 2.

Since the transfer sheet drying device of this invention is thus constructed, the narrow grooves 5 of the heating plate 2 are almost not heated, both side portions of the groove 5 are heated to some degree, and the intermediate portions of the grooves 5 are strongly heated.

Therefore, when the transfer sheet P passes in contact with the heating plate 2, portions thereof are strongly heated (at high temperature), other portions receive substantially less heat and other portions receive almost no heat at all.

Thus, since the portions receiving almost no heat (portion not dried) are elongated so as to result in minimum contraction when the portions strongly heated are contracted, the sheet P is so dried as to be relatively uniform without undulating or wavy portions.

EXAMPLE

In the device shown in FIG. 2, there is a heating plate 2 having a dimension L equal to 370 mm and provided with a plurality of narrow grooves 5 which are 1 mm wide. The grooves are spaced apart 50 mm. The plate is preferably fabricated from copper. A keeper roller 6 having a good heat transfer rate comprises an aluminum pipe 61 having a thin silicone rubber layer 62 thereon.

The keeper roller serves to hold a copy sheet in good thermal contact with the plate 2.

When the transfer sheet P is carried at a linear speed of 60 mm/sec. at temperature of 140° C. by the device thus constructed, it is dried preferably without any waviness.

Figure 3:
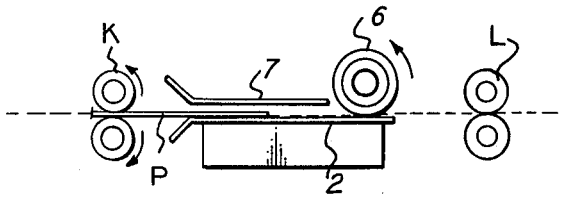
FIGS. 3 and 4 are plan views of the other embodiments of this invention.

As shown in FIG. 3, there may be provided a pre-heating plate 7 preceding the roller 6 so as to allow rotation of the sheet keep roller 6 at a rotary speed of the sheets corresponding to the linear speed. If thus constructed, its heat efficiency is improved so as to obtain sufficient drying effect at low electric power and at low temperature.

When the transfer sheet P is carried with the device thus constructed having the pre-heating plate 7 of 1 mm thick of steel plate, at a linear speed of 100 mm/sec. and at a temperature of 100° C. of the heating plate 2, good results could be obtained without any waviness.

Figure 4:
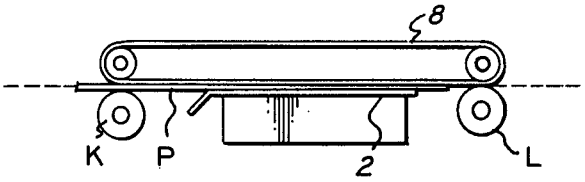

The good effect could also be obtained with a device having a sheet carrying belt 8 mounted directly with a heating plate 2 as shown in FIG. 4.

In the structure of this device, the total width of the heating plate was 260 mm, the width a of the narrow grooves 0.5 mm, the intervals b of the narrow grooves 5 400 mm, and the heating plate 2 was made of aluminum plate. When the sheet P is carried at a linear speed of 60 mm/sec. at a temperature of 100° C. of the heating plate 2, good drying could be obtained without any waviness.

If the length of the heating plate 2 in the sheet carrying direction is properly set according to the sheet carrying speed, it can also be applied to a high speed copying machine without greatly changing the set temperature of heating plate 2.

It should be understood from the foregoing description that since this invention is thus constructed, it can dry only the transfer sheet to be used and the sheet thus dried will not be more wavy.

What is claimed is:

1. Reproduction apparatus comprising:

a photosensitive drum;

means for forming a latent image on said drum;

means for rendering said image visible with a transferable powder;

sheet means to which said visible image is transferred;

means for conveying said sheet means from a sheet means supply into contact with said drum whereby said image is transferred to said sheet means;

means for conditioning said sheet means one at a time prior to their contact with said drum to thereby enhance image transfer thereto; said means for conditioning said sheet means being disposed between said sheet means supply and said drum and comprising means for differentially drying said sheets in a direction perpendicular to the direction of movement thereof and extending across the width of said sheet means, said means for differentially drying said sheet means comprising a heating plate and a roller between which said sheets move, said plate being provided with a plurality of grooves extending in the direction of movement of said sheet means.

2. Apparatus according to claim 1 including a preheater preceding said roller in the direction of movement of said sheets.

3. Reproduction apparatus comprising:

a photosensitive drum;

means for forming a latent image on said drum;

means for rendering said image visible with a transferable powder;

sheet means to which said visible image is transferred;

means for conveying said sheet means from a sheet means supply into contact with said drum whereby said image is transferred to said sheet means;

means for conditioning said sheet means one at a time prior to their contact with said drum to thereby enhance image transfer thereto; said means for conditioning said sheet means being disposed between said sheet means supply and said drum and comprising means for differentially drying said sheets in a direction perpendicular to the direction of movement thereof and extending across the width of said sheet means, said means for differentially drying said sheet means comprising a belt and a heating plate between which said means move said heating plate being provided with a plurality of grooves extending in the direction of movement of said sheet means.

* * * * *